United States Patent [19]

Hauber

[11] Patent Number: 4,966,018

[45] Date of Patent: Oct. 30, 1990

[54] LOW PROFILE, SECURE CAMPER SHELL LATCH

[76] Inventor: Peter Hauber, 9001 No. Glenoaks, Sun Valley, Calif. 91352

[21] Appl. No.: 427,322

[22] Filed: Oct. 25, 1989

Related U.S. Application Data

[63] Continuation of Ser. No. 159,659, Feb. 24, 1988, abandoned.

[51] Int. Cl.[5] ..... E05B 13/10

[52] U.S. Cl. ..... 70/208; 70/367; 70/370; 70/417

[58] Field of Search ..... 70/207, 208, 417, 367, 70/370

[56] References Cited

U.S. PATENT DOCUMENTS

| | | | |
|---|---|---|---|
| 3,122,012 | 2/1964 | Christopher | 70/208 X |
| 3,213,654 | 10/1965 | Dauenbaugh et al. | 70/208 |
| 3,222,899 | 12/1965 | Bodoh et al. | 70/208 Xa |
| 3,548,618 | 12/1970 | Dauenbaugh | 70/208 |
| 3,550,412 | 12/1970 | Pitel et al. | 70/208 X |
| 3,659,444 | 5/1972 | Wellekens | 70/208 X |
| 3,834,198 | 9/1974 | Wiczer | 70/208 |
| 4,552,001 | 11/1985 | Roop | 70/208 |
| 4,760,721 | 8/1988 | Steinbach | 70/208 |
| 4,835,998 | 6/1989 | Steinbach | 70/208 |
| 4,836,001 | 6/1989 | Foshee | 70/367 X |

*Primary Examiner*—Robert L. Wolfe
*Assistant Examiner*—Suzanne L. Dino
*Attorney, Agent, or Firm*—Louis J. Bachand

[57] ABSTRACT

A low profile high security latch 22 is provided comprising inner and outer housing portions 28, 30 defining a common bore 32 in which a shaft 42 moves rotationally and translationally responsive to an attached handle 40, the housing outer portion 30 is outwardly recessed to receive the handle 40 protectively in reduces profile.

10 Claims, 1 Drawing Sheet

LOW PROFILE, SECURE CAMPER SHELL LATCH

This application is a continuation of application Ser. No. 07/159,659, filed Feb. 02, 1988, now abandoned.

TECHNICAL FIELD

This invention has to do with latches for camper shells, truck mounted lockers and cabinets of all descriptions where security needs are accompanied by a desire for a low profile while maintaining easy operation. In particular, the invention relates to a low profile, high security latch assembly in which the latch shaft is axially translatable between inner and outer positions for a low handle profile in a first position and easy grasping of the handle in a second position. The present latch further features the partial enclosing of the handle in a recess which protects the latch from being forced.

BACKGROUND OF THE INVENTION

Camper shells are designed with outward opening rear doors held in place by locking mechanisms comprising a pair of horizontally shiftable arms which interfit with keepers in the shell wall beyond the door. The arm movement between locked and unlocked positions is controlled by an angularly displaceable element which is coupled to the inner ends of the arms and which by rotation shifts the arms into and out of keeper engagement.

SUMMARY OF THE INVENTION

It is an object of the present invention to provide an improved camper shell latch. It is another object to provide such a latch having a handle mounted on an axially movable shaft for a low profile when not in use. It is a further object to provide such a latch in which the latch can be opened from within although locked on the outside. Yet another object is to provide a handle receiving recess for protection of the latch against forcing by an intruder.

These and other objects of the invention are realized in accordance with the present invention by provision of a low profile, high security latch for a camper shell door and the like, comprising a housing having separable inner and outer portions defining a common bore, the housing inner portion including a latch means and the housing outer portion including an outwardly facing recess adapted to receive an outside handle in protected relation, a latch operating shaft journaled in the housing common bore for rotational and translational movement, the shaft being of less length than the common bore, outside handle means fixed to the shaft, the handle means being adapted to rotate the shaft in latch means locking and unlocking relation in a first relatively outward translational position of the shaft freely of the outer housing portion recess and to interfit with the housing outer portion recess in a second relatively inward translational position of the shaft, whereby the profile of the handle is reduced and the handle is protected against unauthorized rotation, and key-operated retainer means selectively retaining the handle and shaft in the second translational position.

In this and like embodiments: the housing, shaft and handle are formed of metal; the housing inner portion defines a handle for operation of the latch from inside; the housing inner portion latch means comprises ears coupling latch arms adapted to latch the door to the housing inner portion for latching and unlatching the door responsive to rotation of the inner housing by the shaft and handle; the housing outer portion is generally T-shaped having laterally disposed arms defining the recess and a center leg defining a portion of the common bore; and, the handle means is generally T-shaped having laterally disposed arms and a center leg, an end of the shaft being fixed in the handle means center leg, the arms being sized and shaped to be received in the handle recess.

In a particularly preferred embodiment: the housing outer portion is generally T-shaped having laterally disposed arms and a center leg, the housing center leg being bored to receive the handle means center leg, the housing arms defining the recess to be congruent with the handle means arms and sized to partially surround the handle means arms; the housing inner portion bore is rectangular, the shaft being generally oval in cross-section within the bore rectangle to permit rotation of the housing inner portion freely on the shaft for unlatching the latch by rotation of the housing inner portion without rotation of the handle and to permit rotation of the housing inner portion by the shaft from outside the door in latching relation; the housing, shaft and handle are formed of metal; the housing inner portion defines a handle for operation of the latch from inside; the housing inner portion latch means comprises ears coupling latch arms adapted to latch the door to the housing inner portion for latching and unlatching the door responsive to rotation of the inner housing by the shaft and handle; the housing outer portion is generally T-shaped having laterally disposed arms defining the recess and a center leg defining a portion of the common bore; the handle means is generally T-shaped having laterally disposed arms and a center leg, an end of the shaft being fixed in the handle means center leg, the arms being sized and shaped to be received in the handle recess; the housing outer portion is generally T-shaped having laterally disposed arms and a center leg, the housing center leg being bored to receive the handle means center leg, the housing arms defining the recess to be congruent with the handle means arms and sized to partially surround the handle means arms; and there is further included spring means normally biasing the outer housing portion outward, the retainer means acting selectively to block outward movement of the outer housing portion by the spring means, and a spring fastener fastening the inner and outer housing portions together in common bore defining relation.

THE DRAWING

The invention will be further described in conjunction with the attached drawing in which.

PREFERRED MODES

Figure 5:
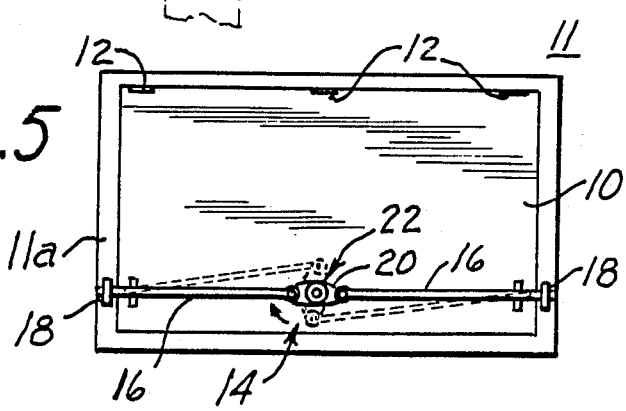
FIG. 5 is a view from inside of the latch installed on a camper shell door.

Turning now to the drawings in detail, the door 10 of camper shell 11 door is seen from within in FIG. 5. The door 10 is hinged to the rear wall panel 11*a* of the shell by a set of three hinges 12 and carries a latching assembly 14 at its lower edge. Latching arms 16 are coupled to ears 20 of latch 22 by pins 23 and move horizontally to latching engagement with latch keepers 18 upon rotation of the latch 22.

Figure 1:
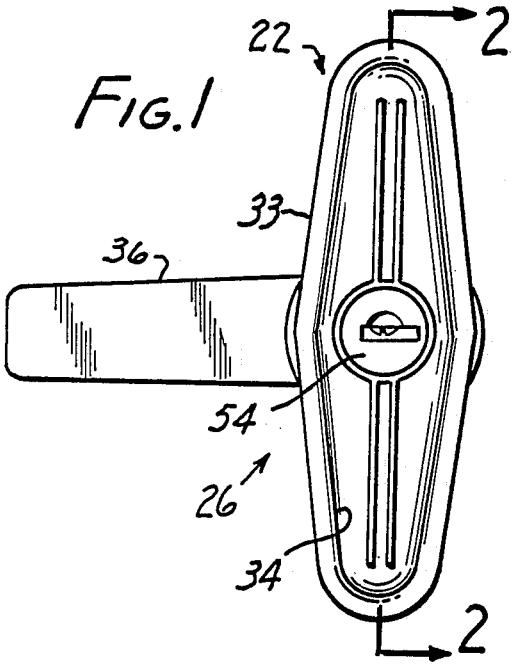
FIG. 1 is a front elevational view of the latch according to the invention.
Figure 2:
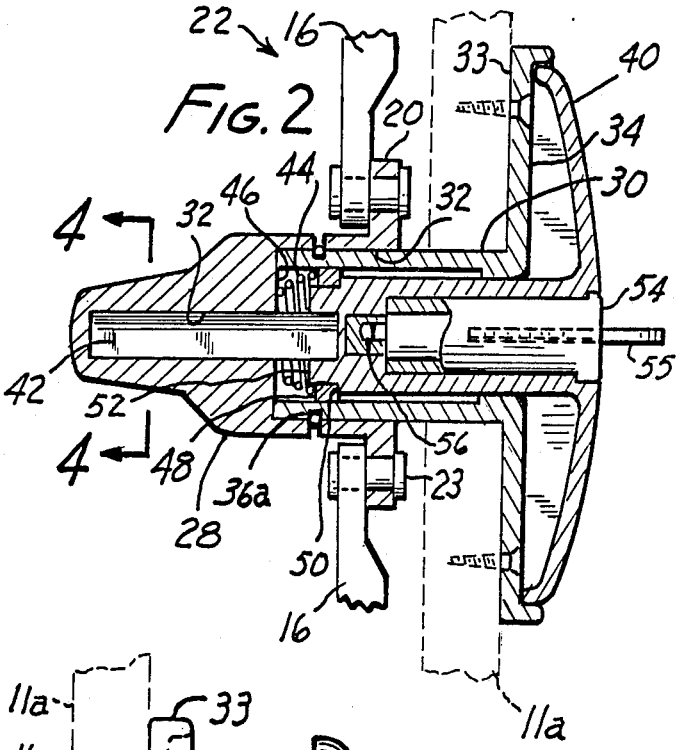
FIG. 2 is a view taken on lines 2—2 in FIG. 1.
Figure 3:
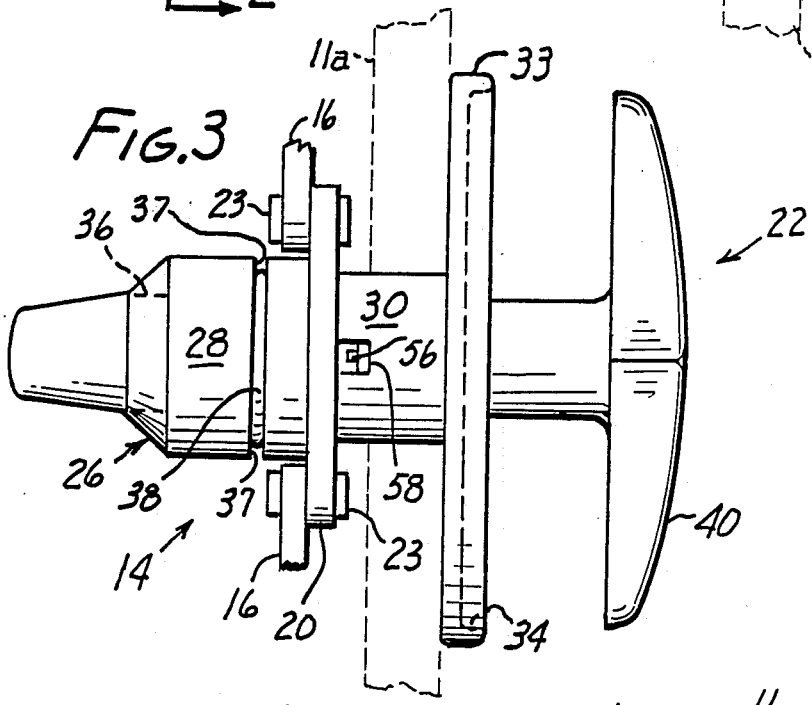
FIG. 3 is a side elevational view of the latch.

With reference now to FIGS. 1, 2 and 3, the latch 22 is seen to comprise a housing 26 having an inner portion 28 and an outer portion 30 which together define the stepped common bore 32. Housing inner portion 28 is generally cylindrical having terminal laterally extending parts defining the previously mentioned ears 20, a transverse fastening clip receiving circumferential groove 36*a*, and a latch means in the form of an integrally formed inside draw handle 36 for purpose of rotating the inner housing portion about its axis for operation of the latch arms 16 from within the camper shell 11 as will be explained below.

Housing outer portion 30 is generally cylindrical with an integrally formed terminal cross-member 33 which defines an outwardly facing recess 34 for purposes to appear. Housing outer portion 30 defines circumferential groove 36*a* which registers with inner housing portion slot 37 for locking with retaining clip 38 in a manner arresting relative axial movement of the portions but permitting their relative rotational movement.

The latch 22 further comprises an outside handle 40, shown to be T-shaped with laterally disposed arms which are outwardly tapered and a central leg portion which is journaled in bore 32 withing outer housing portion 30. A latch operating shaft 42 is fixed to the handle 40 and journaled in bore 32 within inner housing portion 28. A compression spring 44 is provided centered on the shaft 42 and captured between the annular step 46 in bore 32 and spring retaining washer 48 seated on annular flange 50 formed on the outer housing portion inward terminus 52 for purposes of urging the handle 40 outward. A conventional key-operated retainer 54 operated by key 55 and having latch tongue 56 adapted to cooperate with latch keeper opening 58 formed in the outer housing 30 serves to block rotation of the handle 40 and lock the latch 22 when the tongue is extended and limit outward movement of the handle 40 so as to keep a low profile in the latch 22.

Figure 4:
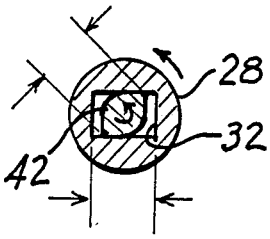
FIG. 4 is a detail view taken on line 4—4 in FIG. 2.

In use, the latch 22 when unlocked will have handle 40 standing out from the recess 34 of the outer housing portion in a manner to be readily grasped and rotated. Rotation in this manner turns the shaft 42 in the bore 32, See FIG. 4, and causes the latch arms 16 to move inward or outward with respect to keepers 18. The inner housing portion 28 may be rotated independently of the shaft 42 for purposes of opening the door 10 whether locked or not on the outside, as a safety feature of the invention latch. For this purpose, within the housing inner portion 28 bore 32 is rectangular, but the shaft 42 is generally oval in cross-section within said bore rectangle. See FIG. 4. This permits rotation of said housing inner portion 28 freely on the shaft 42 for unlatching the latch 22 by rotation of said housing inner portion 28 without rotation of the handle 40. Nonetheless, the shaft will rotate the housing inner portion 28 when the handle 40 is rotated.

A signal feature of the invention is the low profile and high security aspects of the latch. The outer housing portion 30 has the mentioned recess 34 formed therein; it is congruent with the handle 40, and adapted to receive the handle as shown in FIG. 2. The steel wall of the recess 34 thus partially encloses the steel handle 40 and will resist any effort to force rotation of the handle; the entire latch need to be rotated against the securement of the latch outer portion 30 to the door frame 11*a* itself. The handle 40 is depressed into the recess 34 against the force of spring 44 and secured there by latch tongue 56 operated by key 55. As will be observed the handle 40 is partially concealed and has a far lower profile than a conventional handle, making it more attractive, and less likely to catch clothing, eyes, or limbs as well as more secure because of the enclosure thereof.

The foregoing objects are thus met of a high security, low profile camper shell latch.

I claim:

1. Low profile, high security latch for a camper shell door and the like, comprising a housing having separable interfitting inner and outer portions defining a common bore and a zone of interfittment, said housing inner portion including a latch means and said housing outer portion including a outwardly facing recess adapted to receive an outside handle in protected relation, said housing inner portion having a circumferential groove, said housing outer portion having an inner housing groove-opposing slot within said zone of interfittment, clip means encircling said common bore and joining said housing inner and outer portions in common bore defining relation by simultaneously engaging said housing outer portion at its said slot and said housing inner portion at is said circumferential groove against relative axial movement while permitting relative rotational movement between said housing inner and outer portions, a latch operating shaft journaled in said housing common bore for rotational and translational movement, said shaft being of less length than said common bore, outside handle means fixed to said shaft, said handle means being adapted to rotate said shaft in latch means locking and unlocking relation in a first relatively outward translational position of said shaft freely of said housing outer portion recess and to interfit with said housing outer portion recess in a second relatively inward translational position of said shaft, whereby the profile of said handle is reduced and said handle is protected against unauthorized rotation, and key-operated retainer means selectively retaining said handle and shaft in said second translational position.

2. Low profile, high security latch according to claim 1, in which said clip is a spring fastener.

3. Low profile, high security latch according to claim 1, in which said housing outer portion in said zone of interfittment defines a pair of radially opposed slots in registration with said housing inner portion groove, said clip is U-shaped to interfit said slots in groove-received relation, and said housing inner portion bore is rectangular, said shaft being generally oval in cross-section within said bore rectangle to permit rotation of said housing inner portion freely on said shaft for unlatching said latch by rotation of said housing inner portion without rotation of said handle and to permit rotation of said housing inner portion by said shaft from outside said door in latching relation, said slots, groove and clip arrangement permitting said rotation while blocking relative axial movement of said housing inner and outer portions.

4. Low profile, high security latch according to claim 3, in which said housing, shaft and handle are formed of metal.

5. Low profile, high security latch according to claim 4, in which said housing inner portion defines a handle for operation of said latch from inside.

6. Low profile, high security latch according to claim 5, in which said housing inner portion latch means comprises ears coupling latch arms adapted to latch said door to said housing inner portion for latching and unlatching said door responsive to rotation of said inner housing by said shaft and handle.

7. Low profile, high security latch according to claim 6, in which said housing outer portion is generally T-shaped having laterally disposed arms defining said recess and a center leg defining a portion of said common bore.

8. Low profile, high security latch according to claim 7, in which said handle means is generally T-shaped having laterally disposed arms and a center leg, an end of said shaft being fixed in said handle means center leg, said arms being sized and shaped to be received in said handle recess.

9. Low profile, high security latch according to claim 8, in which said housing outer portion is generally T-shaped having laterally disposed arms and a center leg, said housing center leg being bored to receive said handle means center leg, said housing arms defining said recess to be congruent with said handle means arms and sized to partially surround said handle means arms.

10. Low profile, high security latch according to claim 9, including also spring means normally biasing said outer housing portion outward, and retainer means acting selectively to block outward movement of said outer housing portion by said spring means.

* * * * *